US011589175B2

(12) United States Patent
Hurwitz

(10) Patent No.: US 11,589,175 B2
(45) Date of Patent: Feb. 21, 2023

(54) FRUSTRATION-BASED DIAGNOSTICS

(71) Applicant: Google LLC, Mountain View, CA (US)

(72) Inventor: Jonathan D. Hurwitz, San Jose, CA (US)

(73) Assignee: Google LLC, Mountain View, CA (US)

( * ) Notice: Subject to any disclaimer, the term of this patent is extended or adjusted under 35 U.S.C. 154(b) by 251 days.

(21) Appl. No.: 16/863,103

(22) Filed: Apr. 30, 2020

(65) Prior Publication Data

US 2021/0345052 A1 Nov. 4, 2021

(51) Int. Cl.
*H04R 29/00* (2006.01)
*H04R 1/10* (2006.01)

(52) U.S. Cl.
CPC ..... *H04R 29/001* (2013.01); *H04R 1/10* (2013.01)

(58) Field of Classification Search
CPC .... H04R 29/001; H04R 1/10; H04R 2499/11; H04R 29/003; H04R 3/08; H04R 3/007
USPC ..... 381/58–60, 74, 315
See application file for complete search history.

(56) References Cited

U.S. PATENT DOCUMENTS 8,671,347 B2 3/2014 Bromer
9,351,089 B1 5/2016 Chu
9,996,180 B2 6/2018 Uno
10,091,573 B2 10/2018 Yamkovoy
10,467,088 B2 * 11/2019 Kotteri ..... H04L 67/00
11,006,200 B2 * 5/2021 El Guindi ..... H04R 25/30
11,013,404 B2 * 5/2021 Toner ..... A61B 5/163
11,217,251 B2 * 1/2022 York ..... G06F 3/167
2012/0112930 A1 5/2012 Ivanov et al.
2016/0378628 A1 * 12/2016 Nguyen ..... G06F 11/2236 714/40
2018/0020307 A1 * 1/2018 Lehnert ..... H04R 27/00
2020/0314525 A1 * 10/2020 Thielen ..... H04R 1/1041

OTHER PUBLICATIONS

Esther Vasiete Allas, Detecting User Frustration From Smartphone Sensors: A Multimodal Classification Approach, Jan. 1, 2015, 60 pages.

* cited by examiner

*Primary Examiner* — Disler Paul
(74) *Attorney, Agent, or Firm* — Colby Nipper PLLC

(57) ABSTRACT

A method of identifying errors related to a computing device comprising detecting an input to the computing device, comparing the detected input with a threshold, wherein the threshold corresponds to a level of input indicating frustration by a user, determining whether the input meets or exceeds the threshold, and when the input meets or exceeds the threshold, identifying, by the one or more processors, an error related to the computing device.

20 Claims, 6 Drawing Sheets

FRUSTRATION-BASED DIAGNOSTICS

BACKGROUND

Wireless devices, such as wireless headphones, are becoming more popular to avoid the need for wires in wired devices, such as wired headsets, that have a tendency to get tangled and which set a hard limit to the distance the wired headset can travel from a host device, such as a cell phone. As such, wireless devices can provide an improved user experience over wired headphones. However, such wireless devices can become unresponsive to input, leading to instances where a user may be both unable to use the wireless device and unable to determine the reason for the lack of response. For example, a Bluetooth-enabled headset may be outputting audio and then suddenly stop without any input. In such instances, it can be frustrating to the user to try and resolve this issue. Current methods of correcting the headset's unresponsiveness usually involve the user restarting the Bluetooth-enabled headset with no capability of the headset performing a troubleshooting or self-diagnostic process on its own. This issue is compounded in that many current generation commercial Bluetooth-enabled headsets do not have a button located on the headset that is configured to reset the headset. Instead, where a Bluetooth-enabled headset becomes unresponsive, the user would generally have to perform the extra step of placing the headset back in its case to reset the headset and hopefully resolve the issue.

BRIEF SUMMARY

In accordance with an aspect of the disclosure, a method of identifying errors related to a computing device comprising detecting an input to the computing device, comparing the detected input with a threshold, wherein the threshold corresponds to a level of input indicating frustration by a user, determining whether the input meets or exceeds the threshold, and when the input meets or exceeds the threshold, identifying an error related to the computing device. The input may at least one of a tap along a portion of the computing device, shaking of the computing device, voice input, or a gesture. The input may be a series of taps, and the frustration threshold is at least one of a number of taps in a first predetermined amount of time, the taps having a force greater than a predetermined force threshold or an acceleration greater than a predetermined acceleration threshold. The method may further comprise outputting instructions to perform a series of inputs, receiving, in response to outputting those instructions, a series of inputs, and updating the threshold based on the received series of inputs. The method may further comprise addressing the error. Addressing the error may comprise resetting one or more components of the device. Identifying the error may comprise requesting a status of a first component of the computing device. The method may further comprise determining that a response to the request is not received within a second predetermined amount of time, and resetting the first component. The method may further comprise determining that a response to the request is received within a second predetermined amount of time. The first component may be a communication interface and the method may further comprise determining, based on information in the response, a status of a connection with a second device. The method may further comprise outputting a notification based on the status of the connection.

In accordance with another aspect of the disclosure, a self-diagnostic computing device, comprising one or more sensors, memory, one or more processors in communication with the one or more sensors and the memory, the one or more processors configured to receive, from the one or more sensors, an input to the computing device, compare the detected input with a threshold, wherein the threshold corresponds to a level of input indicating frustration by a user, determine whether the input meets or exceeds the threshold, and when the input meets or exceeds the threshold, identify an error related to the computing device. The input may comprise at least one of a tap along a portion of the computing device, shaking of the computing device, voice input, or a gesture. The input may be a series of taps, and the frustration threshold is at least one of a number of taps in a first predetermined amount of time, the taps having a force greater than a predetermined force threshold or an acceleration greater than a predetermined acceleration threshold. The one or more processors may be further configured to reset one or more components of the device in response to identifying the error. Identifying the error the one or more processors may be further configured to request a status of a first component of the computing device, determining whether a response to the request is received within a second predetermined amount of time, and in response to determining whether the response is not received within the second predetermined amount of time, resetting the first component. The computing device may further comprise in response to determining that the response to the request is received within a second predetermined amount of time, determining, based on information in the response, a status of a connection with a second device. The computing device may further comprise outputting a notification based on the status of the connection.

In accordance with another aspect of the disclosure, a non-transitory computer-readable medium housed in a computing device storing instructions, which when executed by one or more processors, cause the one or more processors to receive, from the one or more sensors, an input to the computing device, compare the detected input with a threshold, wherein the threshold corresponds to a level of input indicating frustration by a user, determine whether the input meets or exceeds the threshold, and when the input meets or exceeds the threshold, identify an error related to the computing device. Identifying the error the one or more processors may be further configured to request a status of a first component of the computing device, determining whether a response to the request is received within a second predetermined amount of time, and in response to determining whether the response is not received within the second predetermined amount of time, resetting the first component.

DETAILED DESCRIPTION

Overview

This technology is directed to detecting "frustration" inputs from a user when a computing device becomes unresponsive so that the computing device can perform a self-diagnostic process to automatically attempt to identify the issue. This enables the computing device to attempt to resolve the issue without requiring user intervention, thus allowing for the computing device to more quickly and efficiently return to its normal functioning.

For example, a user may be enjoying content output from a system of wirelessly paired computing devices, such as user 101 listening to audio from wireless devices 110, 120 as shown in FIGS. 1A-1B and 2A-2C. While the system shown in FIGS. 1A-1B and 2A-2C includes earbuds adapted to provide audio content, it should be understood that the system may include any of a variety of types of wirelessly coupled devices, such as headsets, wireless speakers, smartglasses, smartwatches, etc. Such systems may be adapted to output various types of content, such as audio content, video or image content, etc.

Figure 1A:
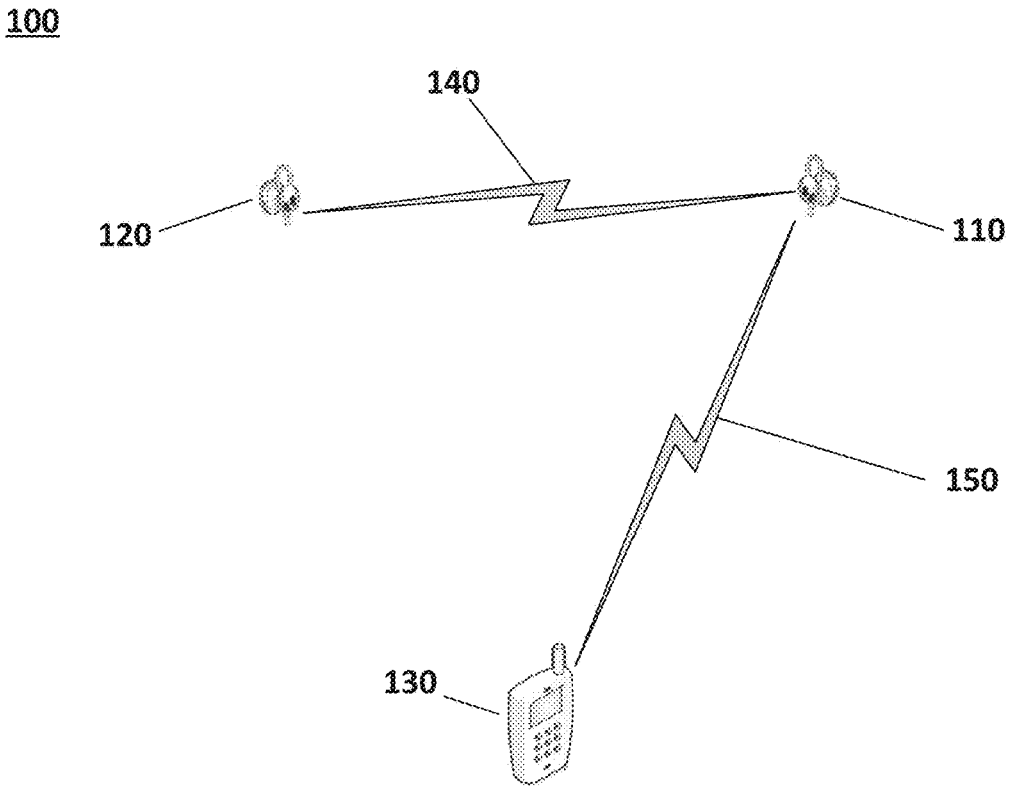
FIGS. 1A-B are schematic views depicting systems of wirelessly paired computing devices in accordance with aspects of the disclosure.
Figure 1B:
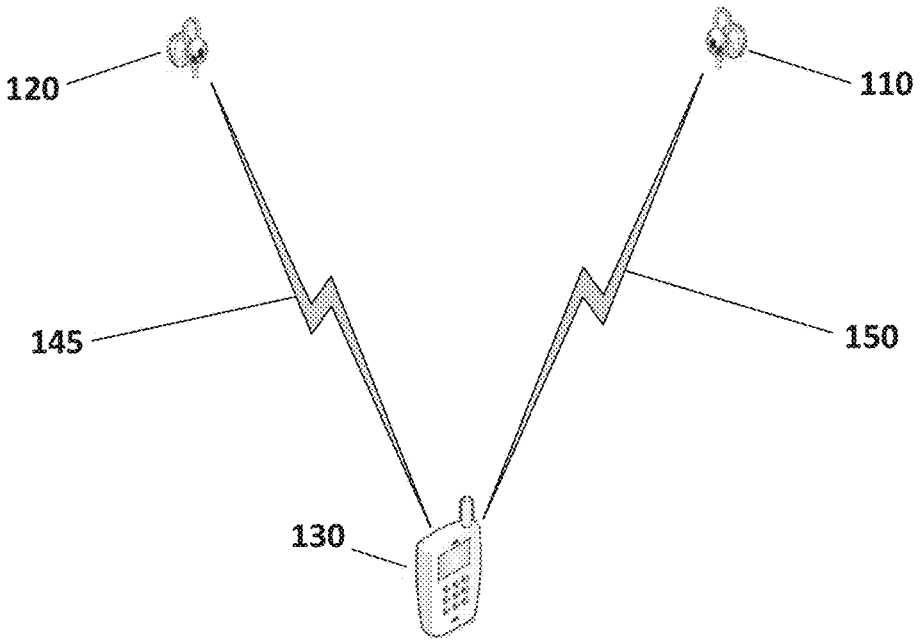
Figure 2C:
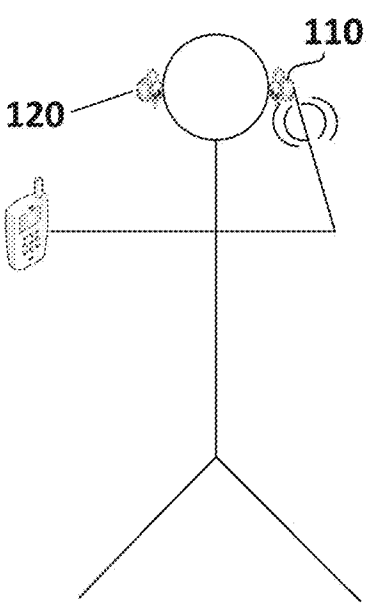
FIGS. 2A-C illustrate an example scenario where a user exerts a force against the system in response to the system becoming unresponsive.
Figure 2B:
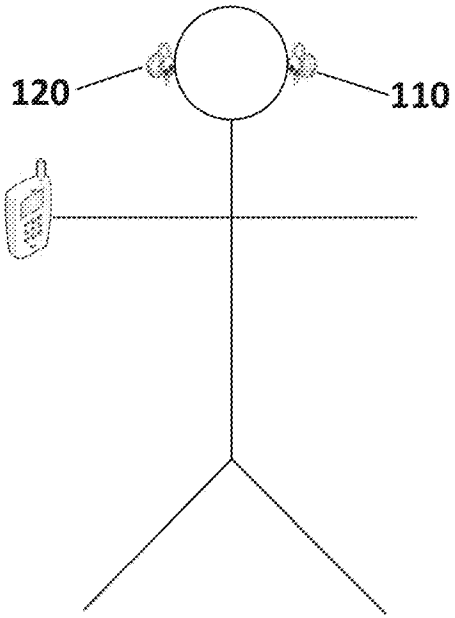
Figure 2A:
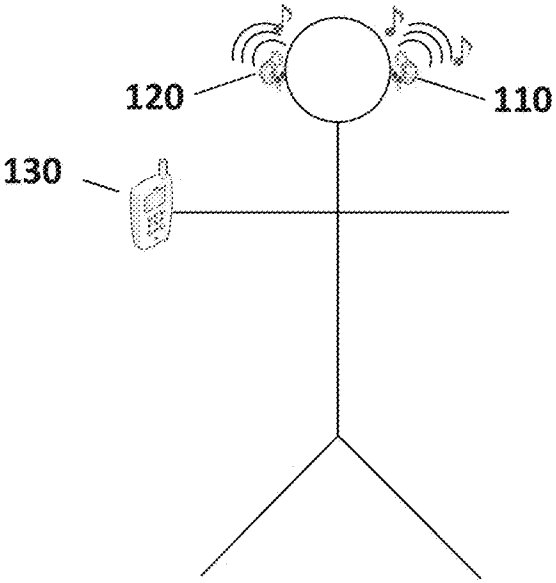

As shown in FIG. 1A, system 100 includes wireless device 110, 120 and host device 130. Wireless device 110 may be the primary device that is in communication with wireless device 120, the secondary device, through connection 140 and host device 130 through connection 150. FIG. 1B depicts another example system of wirelessly paired devices where primary device 110 is in direct communication with host device 130 through connection 150 and secondary device 120 is in direct communication with the host device through connection 145. In an initial state, shown in FIG. 2A, wireless devices 110, 120 may be functioning as normal, such as outputting audio. However one or both of wireless devices 110, 120 may suddenly cease functioning, such as halting or interrupting the audio output, shown in FIG. 2B. User 101 may interact with one or both of wireless devices 110, 120 to attempt to resume output of the content, such as by tapping a portion of primary device 110, as shown in FIG. 2C.

Sensors housed within primary device 110 will detect that input and a processor within the primary device will compare that input with a threshold to determine whether the input is a frustration input. If the input meets a threshold, such as whether the input meets a certain force or acceleration, the processor will determine that the input is a frustration input and initiate a self-diagnostic process to identify and attempt to address errors, if any, of system 100. According to some examples, the threshold may include additional criteria, such as a number of taps within a predefined period of time.

This self-diagnostic process may first include the processor sending a request to other internal components of primary device 110 to request a status of those components. For instance, the sensors may send a request to other processors of primary device 110, such as a system-on-chip (SOC).

Where the processor does not receive a response within a predetermined period of time, the processor instructs the SOC to perform a reset before sending a follow-up request to determine whether the reset was able to resolve the SOC's issues. After the processor receives a response within the predetermined amount of time indicating that the status of the SOC is normal, the processor sends further requests to the other components of primary device 110 to request their statuses and to ensure that the other necessary components of the wireless devices are functioning. For instance, the processor may request the status of a digital signal processor (DSP) or application, specific integrated circuit (ASIC). The processor may also send status requests to other computing devices wirelessly paired with primary device 110, such as secondary device 120 and/or host device 130.

A connection status between the primary device and secondary device 120, and between the primary device and host device 130, may also be verified. This verification may include the processor sending a request to a communication interface, such as to a Bluetooth controller, to request a connection status between the primary device and the other paired devices. For instance, the processor may make a request for a connection status between primary device 110 and secondary device 120.

If the processor does not receive a response within the predetermined period of time, the processor may instruct the communication interface to reset and re-establish a connection with secondary device 120 after the reset. A follow-up request is sent to the reset communication interface to request the connection status of the new connection with secondary device 120 to check whether the reset Bluetooth controller and re-established connection resolved the connection issues.

According to some examples, a response from the communication interface may indicate that a status of the connection is low or normal. For example, a connection status may be low if a signal strength between the primary device 110 and secondary device 120, or a connection between the host device 130 and the primary device or secondary device, is weak. If the processor receives a response within the predetermined period of time that the connection status is low, then the self-diagnostic process may end since a low connection status is an environmental factor that the self-diagnostic process would be unable to fix. In other examples, the system may output a notification to the user indicating that the connection status is low. For example, the notification may be an audio notification through the primary or secondary device, a haptic notification (e.g., a vibration), a visual notification through the host device 130, or any of a variety of other types of notifications. If the connection status is normal or strong, the self-diagnostic process may end as primary device 110 has been diagnosed to be working as intended.

If the processor receives a response indicating that there is no connection, the processor may instruct the communication interface to re-establish a connection before sending a follow-up request to request the connection status of the re-established connection. This second request checks whether the communication interface attempting to re-establish the connection resolved the connection issues. This connection status verification may also be performed between primary device 110 and host device 130 similar to above.

Once the internal components of primary device 110, and the connections between the primary device and other devices have been verified to all be functioning normally, the self-diagnostic process will conclude. System 100 may continue playing content through wireless devices 110, 120. Additionally or alternatively, the system may output a notification that the self-diagnostic process has concluded, such as through an audible output through the wireless devices or on a display of host device 130.

Example Systems

Figure 3:
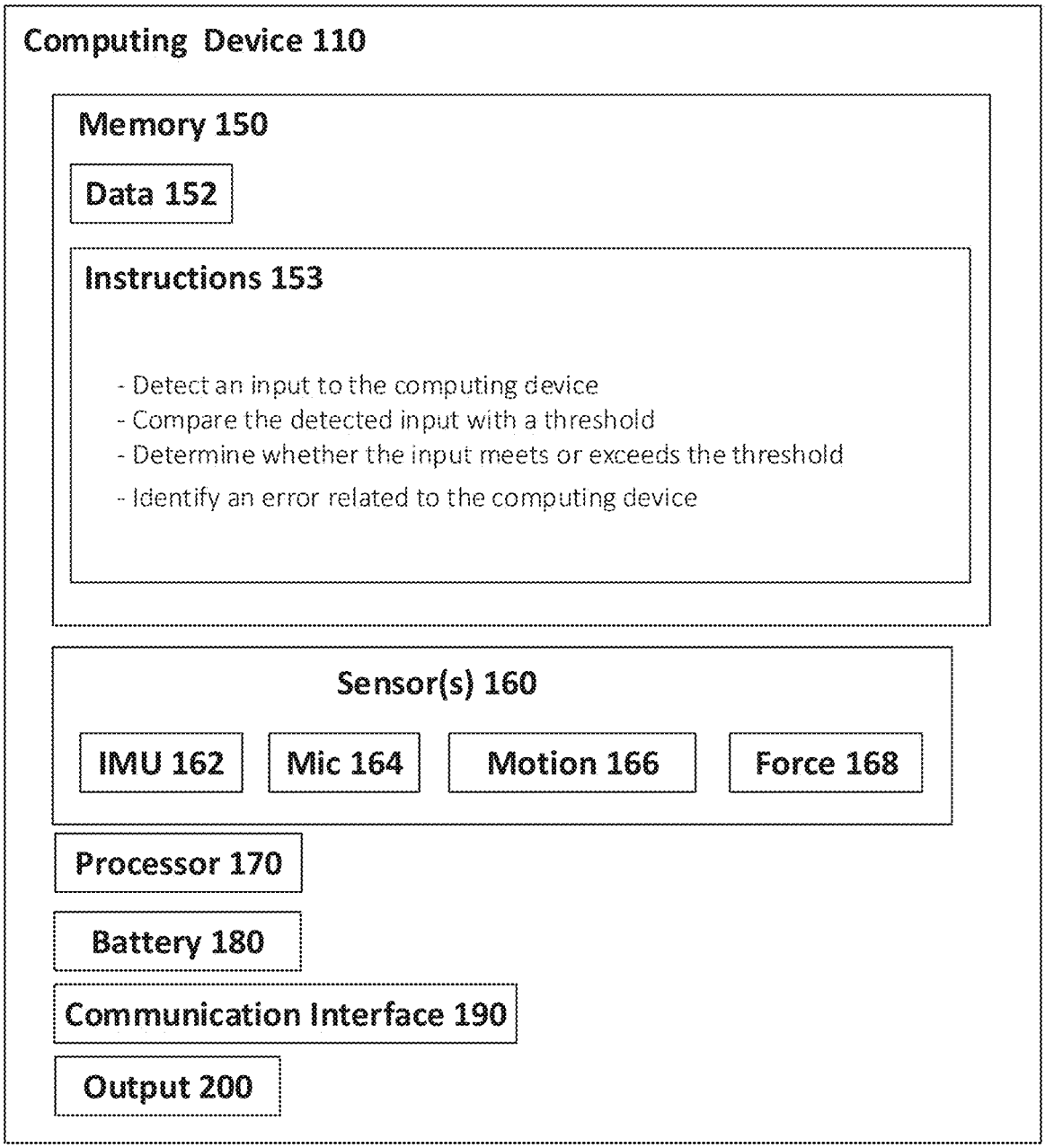
FIG. 3 is a functional block diagram depicting an example computing device according to aspects of the disclosure.

FIG. 3 illustrates an example of internal components of a computing device, such as primary device 110, used in a system of wirelessly paired devices, such as system 100. While a number of internal components are shown, it should be understood that additional or fewer components may be included. By way of example only, primary device 110 may include components typically found in playback devices, such as speakers, microphones, earbuds, or the like. The computing device may be, for example, a wireless accessory, such as wireless earbuds, portable speaker, display, or the like. While the below description relates primarily to primary device 110, it should be understood that secondary device 120 and host device 130 may be similar or identical. In some examples, however, wireless devices 110, 120 and host device 130 may be different types of devices, or have different internal components.

The primary device 110 may include one or more processors 170, one or more memories 150, as well as other components. For example, the device 120 may also include one or more sensors 160, a communication interface 190, and a battery 180.

The memory 150 may store information accessible by the one or more processors 150, including data 152 and instructions 153 that may be executed or otherwise used by the one or more processors 170. For example, memory 150 may be of any type capable of storing information accessible by the processor(s) 170, including a computing device-readable medium, or other medium that stores data that may be read with the aid of an electronic device, such as a volatile memory, non-volatile as well as other write-capable and read-only memories. By way of example only, memory 150 may be a static random-access memory (SRAM) configured to provide fast lookups. Systems and methods may include different combinations of the foregoing, whereby different portions of the instructions and data are stored on different types of media.

The data 152 may be retrieved, stored or modified by the one or more processors 170 in accordance with the instructions 153. Data 152 may also include information stored from sensor(s) 160. For instance, data 152 may include information regarding inputs detected by one of sensor(s) 160. This can be in the form of pressure or motion readings from an IMU 162, audio readings from a microphone 164, and/or motion sensing from a *soli* radar 166. Although the claimed subject matter is not limited by any particular data structure, the data may be stored in computing device registers, in a relational database as a table having a plurality of different fields and records, XML documents or flat files. The data may also be formatted in any computing device-readable format.

The instructions 153 may be any set of instructions to be executed directly (such as machine code) or indirectly (such as scripts) by the one or more processors 170. For example, the instructions may be stored as computing device code on the computing device-readable medium. In that regard, the terms "software," "instructions," and "programs" may be used interchangeably herein. The instructions may be stored in object code format for direct processing by the processor 170, or in any other computing device language including scripts or collections of independent source code modules that are interpreted on demand or compiled in advance. For example, sensor 160 may detect an input such as a physical tap along a portion of primary device 110, and store that input in memory 150 as data 152. Processor 170 may then execute retrieve and instructions 153 to determine whether the input meets a threshold to be considered a frustration input. Where the input meets the threshold, and is therefore considered a frustration input, the processor can send a request to another component, such as another processor, of primary device 110 to request a status of that component. Where processor 170 receives a response from the other internal components of primary device 110 indicating a normal status, processor 170 can send a request to communication interface 190 to verify the connection status between primary device 110 and other paired devices.

Further, memory 150 may house a machine-learning model that is trained and stored in the memory prior to a user first using primary device 110. Additionally or alternatively, a customized threshold may be generated specific to each user through instructions being provided as an audio output or visual display through output 200. As such, output 200 may be speakers, a display, a vibration element, or any other means of providing information to a user. Functions, methods and routines of the instructions are explained in more detail below.

The one or more processors 170 may be microprocessors, logic circuitry (e.g., logic gates, flip-flops, etc.) hard-wired into the device 110 itself, or may be a dedicated application specific integrated circuit (ASIC). It should be understood that the one or more processors 170 are not limited to hard-wired logic circuitry, but may also include any commercially available processing unit, or any hardware-based processors, such as a field programmable gate array (FPGA). In some examples, the one or more processors 170 may include a state machine or a digital signal processor (DSP) for a microphone. Each component within primary device 110 can have their own processor in communication with processor 170. For instance, sensors 160 and communication interface 190 may also have processors (not shown) similar to processor 170 to communicate with processor 170. Further, the processors within sensors 160 and communication interface 170 may execute instructions (not shown) to perform a method similar to instructions 153.

The one or more sensors 160 may include any of a variety of mechanical or electromechanical sensors for detecting inputs or conditions relevant to other operations. Such sensors may include, for example, an accelerometer, gyroscope, switch, light sensor, barometer, audio sensor (e.g., microphone 164), vibration sensor, heat sensor, radio frequency (RF) sensor, inertial measurement unit (IMU) 162, motion sensor 166 (such as a short range radar), capacitive sensor, resistive sensor, capacitance gasket, or the like. Sensor 160 may be powered by battery 180 onboard primary device 110 or may include its own battery (not shown). Where sensor 160 is powered by its own battery, the sensor may be on even when primary device 110 is not turned on.

The communication interface 190 may be used to form connections with other devices, such as paired secondary device 120 or host device 130. The connection may be, for example, a Bluetooth connection or any other type of wireless link. By way of example only, connections with other devices may include an asynchronous connection-less (ACL) link. The communication interface 190 may also be used to form a backchannel communication link with another wirelessly paired device. For example, where the primary device 110 is an earbud, the primary device may form a backchannel communication link with another earbud, such as secondary device 120. Further primary device 110 can form a communication link with a host device, such as host device 130. This backchannel link may include a Bluetooth link, such as BLE, an NFMI link, or other types of links.

Communication interface 190 may include a wireless communication controller, such as a Bluetooth controller, in communication with processor 170. The controller may be configured to execute instructions, such as a stack program, stored within communication interface 190 or memory 150 to provide a connection status between primary device 110 and other paired devices to processor 170.

Although FIG. 3 functionally illustrates the processor, memory, and other elements of device 110 as being within the same block, it will be understood by those of ordinary skill in the art that the processor and memory may actually include multiple processors and memories that may or may not be stored within the same physical housing. For example, memory 150 may be a volatile memory or other type of memory located in a casing different from that of computing device 110. Moreover, the various components described above may be component of one or more electronic devices.

Example Methods

In addition to the operations described herein and illustrated in the figures, various operations will now be described. It should be understood that the following operations do not have to be performed in the precise order described below. Rather, various operations can be handled in a different order or simultaneously, and operations may also be added or omitted.

Figure 4:
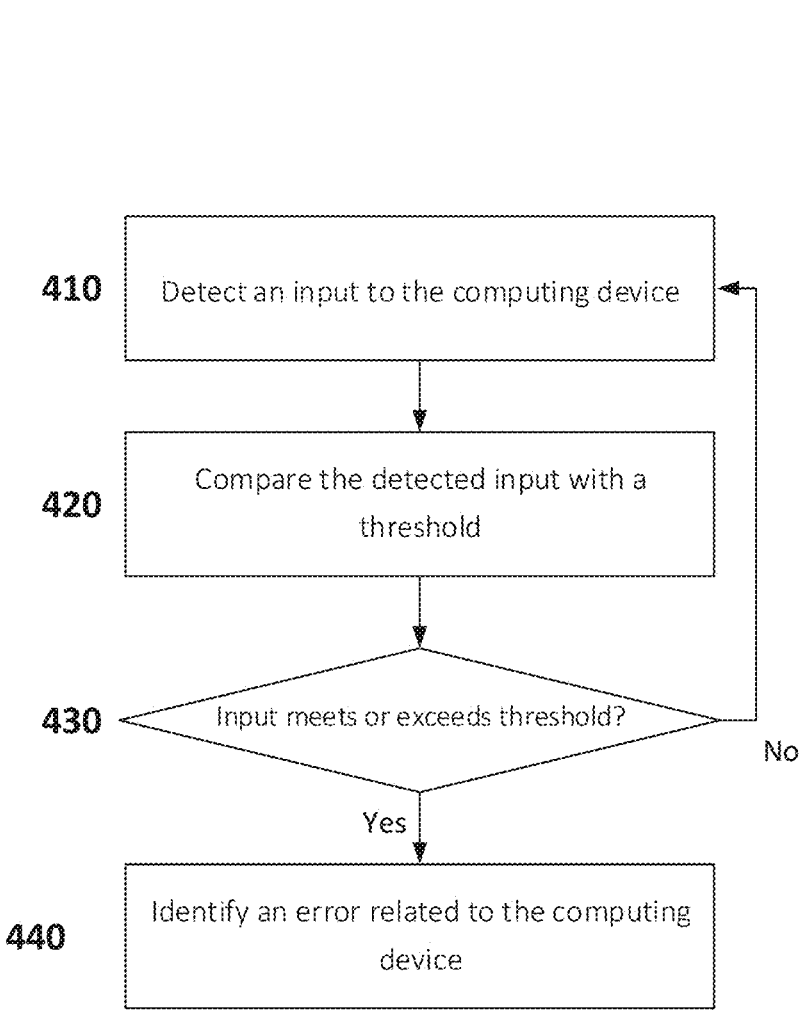
FIG. 4 is an example flowchart depicting a method detecting user frustration in accordance with aspects of the disclosure.

FIG. 4 depicts an example flowchart 400 describing a method of determining whether an input is a frustration input and initiates a self-diagnostic process towards identifying and attempting to address errors, if any, of a system of wireless paired computing devices. With reference to FIGS. 1-3, system 100 includes wireless devices 110, 120 being in wireless communication with host device 130. For instance, wireless device 110 may be the "primary" device while wireless device 120 may be the "secondary" device. Primary device 110 is in wireless communication with host device 130 through connection 150 and secondary device 120 through connection 140 without the second device communicating with the host device. However, in alternative aspects, system 100 can have any combination of connections amongst devices 110, 120, 130. For example, all of devices 110, 120, 130 may be in wireless communication with each other, or both the wireless devices may be in wireless communication with the host device but not with each other. As such, although the below method will be discussed with reference to primary device 110, it is understood that the same method can also be performed by secondary device 120.

Turning to block 410, sensors 160 can detect inputs, such as user inputs to any of the devices. In one example, sensor 160 may be an IMU 162 housed in primary device 110 that detects motion (e.g., acceleration) relative to the primary device 110. For example, such motion can include movement of sensor 160 through physical taps along a portion of the primary device, a user 101 shaking the primary device, a user throwing the primary device, etc. The IMU 162 may include one or a combination of sensors, such as accelerometers, gyroscopes, etc., for detecting inertial movement of the primary device 110.

In some examples, sensors 160 may include a microphone 164 configured to detect inputs through audio detection. For instance, microphone 164 may receive audio inputs recorded as blocks of sample audio and processor 170 may run those blocks through a loudness detection algorithm stored in memory 150 to detect groupings of decibel peaks. Each decibel peak grouping can indicate an input, such as a tap against primary device 110. For example, a decibel peak grouping of 70-85 dB in a relatively quiet environment can identify a tap. Other sensors, such as IMU 162, may be used in conjunction with the microphone 164 to supplement input detection. For example, such additional sensors may be particularly advantageous in distinguishing frustration taps from background noise, such as where the audio is in a loud environment that may already register at 85 dB or above. The audio input may also include voice inputs, such as a phrase or the like.

In another example, sensors 160 may include a motion sensor 166, such as a short range radar, configured to detect inputs in the form of user movement or gestures. These movements or gestures can be determined by the reflection of light or energy from a user as a function of time and distance. In this manner, the input may be determined from a movement or gesture of a certain speed that is aimed towards or near primary device 110 indicating an input, such as a tap.

In a yet further example, sensors 160 may include a force sensor 168 (such as a capacitive sensor, resistive sensor, or capacitance gasket) configured to detect inputs through a change in pressure or force. In this instance, the input may be determined from a force (such as from a tap) applied to a portion of primary device 110.

Turning to block 420, a processor 170 will compare the detected input with a threshold. Meeting or exceeding the threshold will determine whether the input is a frustration input or not. In one instance, the threshold can be based on the inputs detected by the one or more sensors 160 in a predetermined period of time, such as a first number of taps within a second number of milliseconds or seconds). Where the number of taps in that predetermined period of time is less than a threshold amount, processor 170 can determine that the input is not a frustration input and halt any further actions towards the self-diagnostic process. However, where the number of taps in that predetermined period is equal to or greater than the threshold amount, the processor can determine that the input is a frustration input.

Further, the threshold may include a certain amount of time difference between the inputs. Where sensor 160 detects a series of inputs and the time between each success input changes, processor 170 can compare the amount of time between each successive input with the threshold to determine whether the inputs are frustration inputs. For instance, sensors 160 can detect three inputs having a first time between a first input and a second input, and a second time between the second input and a third input. In such a case, the threshold can be met where the second time is larger than the first time by a certain amount (e.g., a difference of 0.02 seconds, or the like). In this manner, the threshold may require a certain amount of time difference between each successive input to meet the threshold.

In other examples, the threshold may include a certain acceleration associated with the motion. For instance, where sensors 160 detect an input that moves the sensor at an acceleration to meet the threshold acceleration, processor 170 can consider the input a frustration input.

The threshold may also be determined based on the force applied from each tap. For instance, where an input includes a tap greater than 1 Newton, the processor may consider such an input as a frustration input. In other examples, the processor may consider the number of inputs greater than a given force threshold over a predetermined period of time in determining whether an input is a frustration input. By way of example only, if the first number of taps are received within the second number of seconds, but most of the first number of taps are not made with sufficient force to meet the threshold, the processor may not consider such input as rising to a level of frustration.

In a further example, the threshold may be met when at least one of wireless devices 110, 120, such as primary device 110, moves at a predetermined speed, such as from a user shaking the device. In such an instance, the threshold may further require that primary device 110 rapidly change both speed and direction. For example, the threshold may require that primary device 110 move at a first threshold speed, such as 10 m/s or greater, in a first direction before stopping and moving at the first threshold speed in a second, different direction. In this manner, the threshold requirements may help differentiate primary device 110 moving when a user 101 is shaking the device from when the device is moving in a car, being worn while the user is running, or the like.

In a yet further example, where sensor 160 is a microphone 164, the threshold may be a voice input having a certain volume, being a certain phrase, or both. For example, the threshold may require that a certain frustration phrase is being used (e.g., "Why won't this thing work?") in determining whether there is a frustration input. Further, the threshold may also require that such a phrase be over a certain decibel level to be considered a frustration input, such as 80 dB or higher.

Alternatively or additionally, the threshold may be incorporated in a machine-learning model stored in memory 150 prior to manufacture of primary device 110. The machine-learning model can be trained to optimally determine the threshold to categorize an input as a frustration input using data voluntarily provided by other users or data manufactured during testing of the machine-learning model. In this manner, for example, the threshold may be determined by the machine-learning model to require a number of taps within a precise period of time to categorize frustration inputs.

Alternatively, the machine-learning model can be trained to create a custom threshold for user 101. In this instance, the custom threshold can recognize input patterns that can indicate frustration specific to the user. For instance, processor 170 can instruct output 200 to provide instructions to user 101 to perform a series of inputs that is directed to mimicking the user's inputs when frustrated. Such instructions may be provided through output 200 by at least one of an audio output from a speaker on at least one of wireless devices 110, 120, 130 and/or visual output on a display of the host device 130. The series of inputs received in response to the instructions is then stored in the machine-learning model and used to update the threshold to be a custom threshold for the user.

For example, the instructions may ask the user to provide a number of inputs, such as taps, mimicking the user being frustrated. Further, the instructions may request the user repeat the inputs multiple times to get an adequate number of samples for generating the model. In this example, user 101 may provide two taps in, on average, 0.25 seconds across three series of inputs. These inputs are stored in the memory and used to update the threshold such that, to meet the custom threshold, there must be at least two taps in 0.25 seconds for the processor to register a frustration input. Additionally or alternatively, the time between the first and second tap may have a first time of 0.05 seconds, and a second time between the second tap and the third tap may be 0.03 seconds. The custom threshold may be updated such that there must be a difference of at least 0.02 seconds between the second time and the first time for the input to be considered a frustration input. Further, sensors 160 may detect that it has been moved with an average acceleration of 5 $m/s^2$ across the series of user inputs. The custom threshold may be updated such that the input must accelerate sensor 106 with at least 5 $m/s^2$ to be considered a frustration input. In this manner, the model may provide a custom threshold specific to the user. Once the custom threshold has been created, wireless devices 110, 120 may ask the user whether the user would like the devices to keep track of further input data from the user to better fine tune the custom threshold for the user moving forward.

The machine-learning model can also be trained to recognize a custom threshold using voice input. For instance, where sensor 160 is a microphone 164, the instructions may request user 101 to provide a voice input indicating frustration, such as a certain phrase, and to repeat the voice input a number of times. In a further alternative, where sensor 160 is an IMU 162, the custom threshold may be directed to a specific speed and direction of user 101 shaking primary device 110. Similar to above, the instructions may require user 101 to shake primary device 110 as the user would when frustrated and to repeat such shaking a number of times.

Although the method has discussed the use of each type of sensor 160 in isolation, it is understood that one or more types of sensors 160 may be used together. For instance sensors 160 can include all of IMU 162, microphone 164, *soli* radar 166, force sensor 168, or any combination thereof.

Turning to block 430, processor 170 determines whether the input meets the threshold. Where the threshold is met, processor 170 will categorize the input as a frustration input. Otherwise, processor 170 will categorize the input as being a normal input and wait for further input.

Turning to block 440, when the threshold is met and the input is categorized as a frustration input, processor 170 will initiate the self-diagnostic process to identify errors related to primary device 110. For example, as described in further detail in connection with FIGS. 5 and 6, the self-diagnostic process may include checking the status of internal components within primary device 110 (FIG. 5), and verifying the connection status of connections with other wireless computing devices paired with the primary device (FIG. 6).

Figure 5:
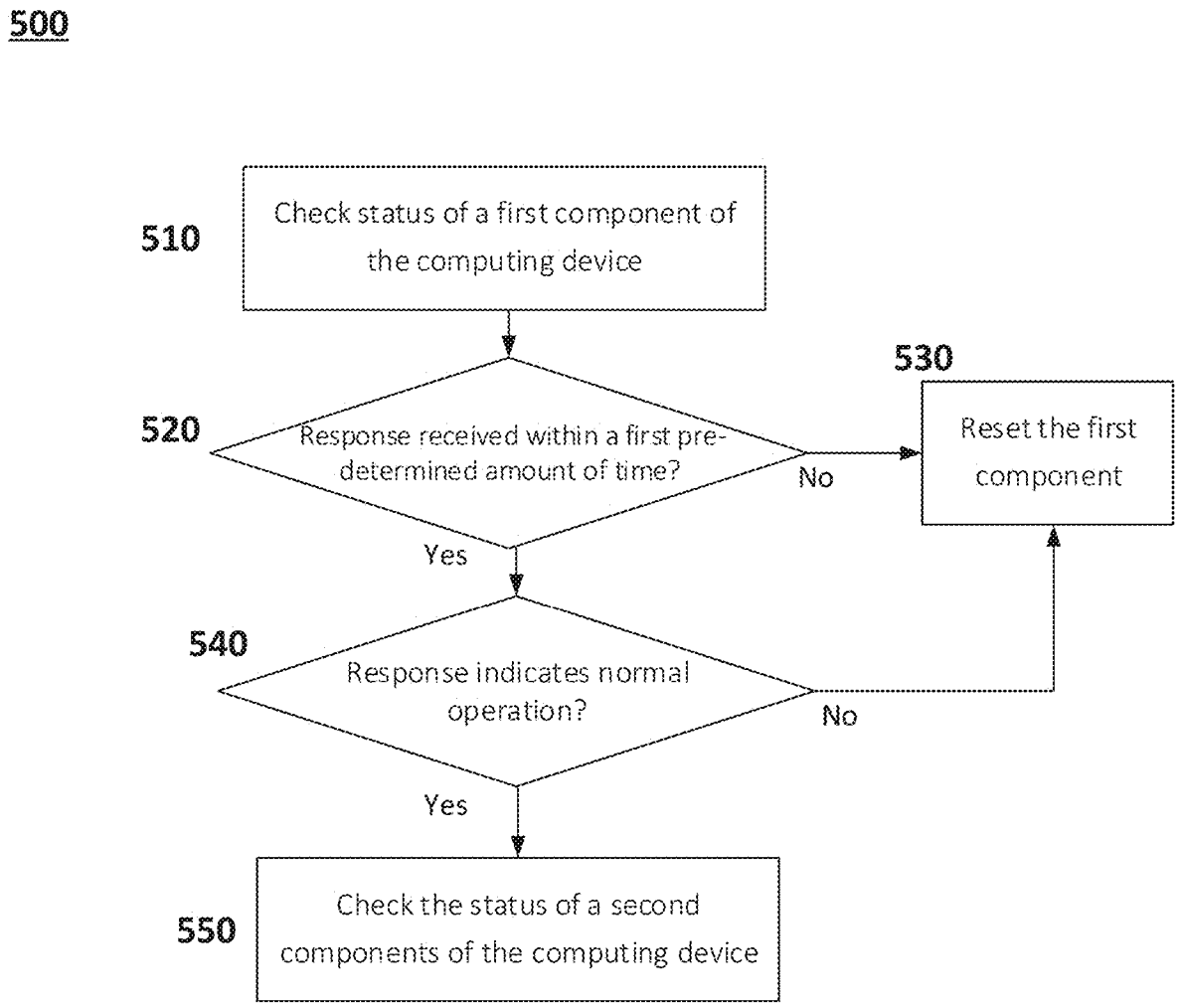
FIG. 5 is an example flowchart depicting a method of identifying errors in the computing device in accordance with aspects of the disclosure.
Figure 6:
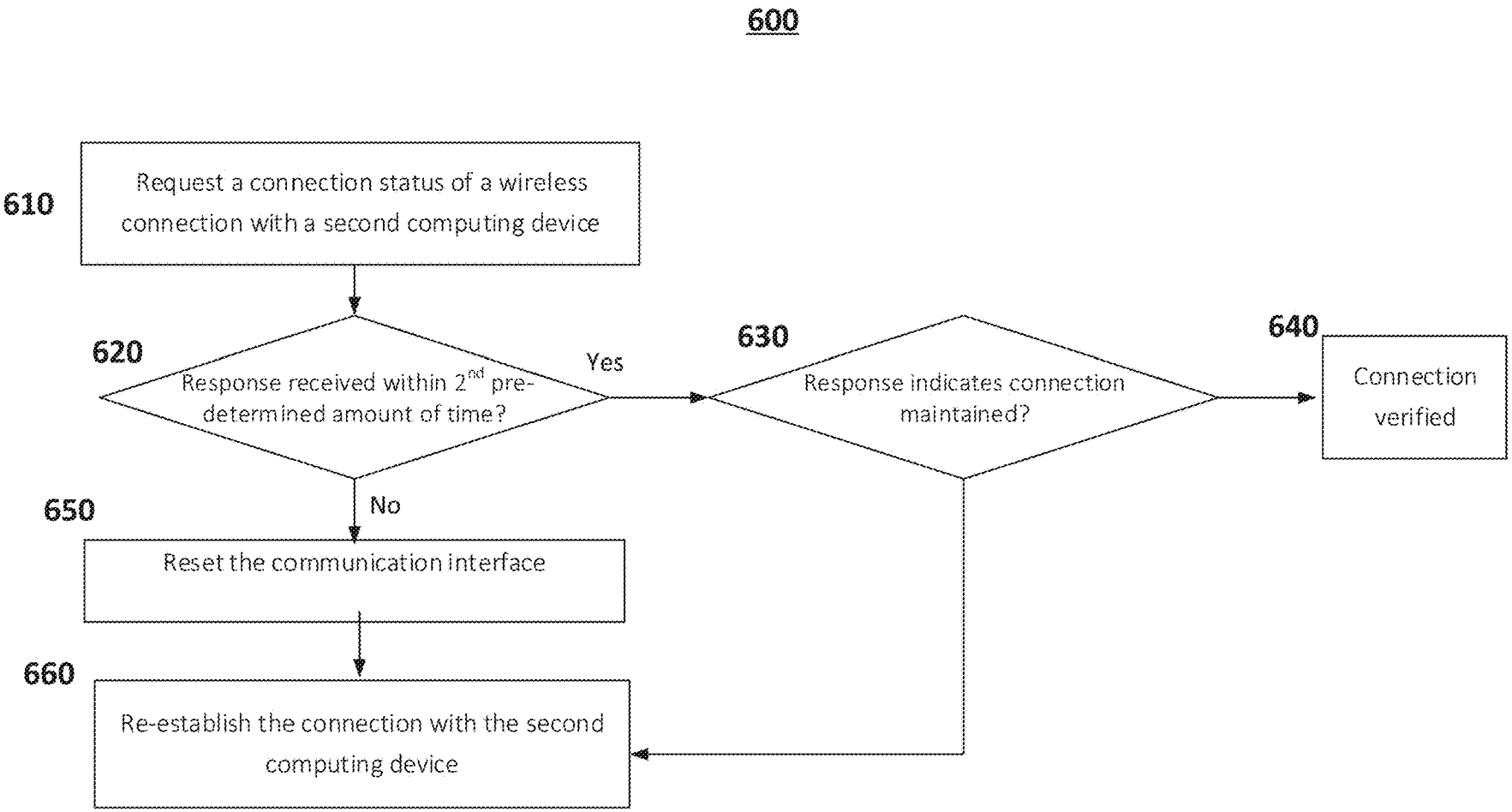
FIG. 6 is an example flowchart depicting a method of identifying connection errors in accordance with aspects of the disclosure.

FIG. 5 depicts an example flowchart 500 describing a method of checking the status of various internal components within primary device 110. Turning to block 510, processor 170 will check the status of the internal components of primary device 110 by sending a status request to each component. For instance, processor 170 may request the status of a separate processor housed within primary device 110, such as the SOC, DSP, ASIC, or the like. The component then has a first predetermined amount of time to send a response indicating the status of the component.

According to some examples, the status request may be sent in sequence, such as by order of importance, to each component. In other examples, requests can be sent in bulk to multiple components of the system at once. In one example, there may be a dedicated input signal that triggers a status request to be sent to all the components of primary device 110. Each component could read when that signal goes high or low at the same time once its issued. Sending the request signals in bulk may save time in performing the self-diagnostic process.

Turning to block 520, processor 170 considers whether a response is received within a first predetermined amount of time. Turning to block 530, where processor 170 does not receive a response from the SOC within a predetermined period of time, or the response status indicates the SOC is not functioning normally, processor 170 may reset the SOC.

Once the SOC has reset, processor 170 may send a follow up status request to the SOC to confirm that the reset SOC is fully functioning.

Turning to block 550, if processor 170 receives a status from the SOC within the first predetermined amount of time indicating that the SOC is functioning normally, processor 170 can move on to checking the status of a second component of primary device 110 by sending further status requests to other components of primary device 110. This can include sending requests to other processors housed within primary device 110, such as a separate DSP, an ASIC, or other hardware feature of wireless devices 110 for their status. As with the SOC, if processor 170 does not receive a response from other components of the system status within a predetermined amount of time, processor 170 instructs that component to reset and sends a follow-up status request to the reset component. Further, processor 170 may check the status of components of other wireless paired devices, such as secondary device 120, by also sending status requests to the components of that device.

The self-diagnostic process may also check the connection status of wirelessly connected devices with the primary device, as shown in flowchart 600 of FIG. 6. Turning to block 610, the device may request a connection status of a wireless connection with a second computing device, such as with secondary device 120 or host device 130. For example, the request may be sent to communication interface 190, such as a wireless pairing controller, to request a connection status between primary device 110 and, for example, secondary device 120 or host device 130. Communication interface 190 has a second predetermined amount of time to send a response indicating the connection status.

Turning to block 620, processor 170 determines whether a response is received within a second predetermined amount of time. If processor 170 has not received a response from communication interface 190 within the second predetermined amount of time, processor 170 can instruct the communication interface to reset (block 650) and re-establish the connection with the second computing device after the reset (660). Once communication interface 190 has reset and has re-established the connection with the second computing device, processor 170 can send another request signal to communication interface 190 to request the connection status of the re-established connection to ensure that the connection is now functioning properly.

If processor 170 receives a response from the wireless communication interface in block 620, according to some examples, the response may include information about the connection, such as signal strength, bandwidth, etc. Such information may indicate a status, such as low signal strength, no connection, normal connection, etc.

In block 630 may be determined whether the connection is maintained in some form, such as a normal connection or a weak connection. If the connection status from communication interface 190 is received within the second predetermined amount of time indicating that the signal strength is low, the connection may be verified (block 640). For example, processor 170 can terminate the self-diagnostic process as a low signal strength is an environmental factor that cannot be affected or improved by wireless devices 110, 120. According to some examples, an output may be provided to the user indicating that signal strength is low. Similarly, if processor 170 receives a connection status within the second predetermined amount of time indicating that the signal strength is normal or greater, the connection may be verified (block 640), and the processor can cease the self-diagnostic process as primary device 110 is functioning as intended.

If it is determined in block 630 that there is no connection signal, the processor instructs the communication interface to re-establish the lost connection with the second computing device (block 660). Once the connection is re-established, the processor can send another request to communication interface 190 to request the connection status of the re-established connection to ensure that the connection is functioning correctly.

According to some examples, the method 600 may be performed to diagnose a connection status with a first device, such as a slave earbud, and then subsequently performed to diagnose a connection status with a second device, such as the host. According to other examples, the method 600 may diagnose connections of multiple wirelessly connected devices simultaneously.

During any part of the self-diagnostic process, processor 170 can instruct output 200 to provide an audio notification (e.g., out of the speakers of wireless devices 110, 120) or a visual notification (e.g., on a display of host device 130) informing the user of any detected issues and the actions being taken to remedy those issues. For instance, where a component of primary device 110 does not provide a status request, output 200 may notify user 101 that the specific component is not functioning correctly and is being reset. Further, where the component is not functioning correctly even after being reset, output 200 may notify user 101 that the component is damaged and requires repair. A similar notification system can be provided when verifying the connection status.

Although the subject matter herein has been described with reference to particular examples, it is to be understood that these examples are merely illustrative of the principles and applications of the subject matter described. It is therefore to be understood that numerous modifications may be made and that other arrangements may be devised without departing from the spirit and scope as defined by the appended claims.

The invention claimed is:

1. A method comprising:

detecting, by one or more sensors, an input to a computing device;

comparing, by one or more processors, the detected input with a frustration threshold, the threshold corresponding to a level of input indicating frustration by a user;

determining, by the one or more processors, whether the detected input meets or exceeds the frustration threshold;

responsive to the detected input meeting or exceeding the frustration threshold, identifying, by the one or more processors, an error related to a first component of the computing device; and responsive to identifying the error related to the first component of the computing device, resetting the first component.

2. The method of claim 1, wherein the detected input to the computing device comprises at least one of a physical interaction with the computing device by the user, an audible output from the user, or a movement by the user.

3. The method of claim 2, wherein the physical interaction with the computing device comprises a series of taps, and wherein the frustration threshold comprises at least one of a number of taps a force associated with the series of taps, or an acceleration associated with the series of taps.

4. The method of claim 1, wherein the first component of the computing device comprises a system-on-chip.

5. The method of claim 1, further comprising:

requesting, prior to identifying the error, a status of the first component of the computing device.

6. The method of claim 5, further comprising:

determining that a response to the request that is indicative of the status of the first component is not received within a second predetermined amount of time, and wherein identifying the error is based at least in part on determining that the response to the request is not received within the second predetermined amount of time.

7. The method of claim 5, further comprising:

receiving a response to the request that is indicative of the status of the first component within a second predetermined amount of time.

8. The method of claim 7, wherein the first component is a communication interface, the method further comprising:

determining, based on the response, a status or quality of a connection with a second device.

9. The method of claim 8, further comprising outputting, prior to resetting the first component, a notification indicative of the status of the connection between the first component and the second device.

10. The method of claim 1, wherein determining whether the detected input exceeds the frustration threshold is determined using a machine-learned model.

11. The method of claim 10, wherein the machine-learned model is trained to:

create a custom frustration threshold for each user; and store the custom frustration threshold in memory for each user.

12. The method of claim 11, wherein the machine-learned model is configured to update the stored custom frustration threshold based on a current user.

13. The method of claim 12, further comprising, outputting, responsive to identifying the error, a notification to a current user, and wherein the notification is curated based on the custom frustration threshold associated with the current user.

14. A computing device comprising:

one or more sensors;

one or more processors:

memory storing one or more programs, the one or more programs comprising instructions, which when executed by the one or more processors cause the one or more processors to:

detect, by the one or more sensors, an input to the computing device;

compare, by one or more processors, the detected input with a frustration threshold, the threshold corresponding to a level of input indicating frustration by a user;

determine, by the one or more processors, whether the detected input meets or exceeds the frustration threshold;

responsive to the detected input meeting or exceeding the frustration threshold, identify, by the one or more processors, an error related to a first component of the computing device; and responsive to identifying the error related to the first component of the computing device, reset the first component.

15. The computing device of claim 14, wherein the detected input to the computing device comprises at least one of a physical interaction with the computing device by the user, an audible output from the user, or a movement by the user.

16. The computing device of claim 15, wherein the physical interaction with the computing device comprises a series of taps, and wherein the frustration threshold comprises at least one of a number of taps, a force associated with the series of taps, or an acceleration associated with the series of taps.

17. The computing device of claim 14, wherein the determination of whether the detected input exceeds the frustration threshold is determined using a machine-learned model.

18. The computing device of claim 17, wherein the memory further comprises instructions for the machine-learned model, which when executed by the one or more processors cause the one or more processors to:

create a custom frustration threshold for each user; and store the custom frustration threshold in memory for each user.

19. The computing device of claim 18, wherein the memory further comprises instructions for the machine-learned model, which when executed by the one or more processors cause the one or more processors to:

update the stored custom frustration threshold based on a current user.

20. The computing device of claim 19, wherein the memory further comprises instructions for the machine-learned model, which when executed by the one or more processors cause the one or more processors to:

output, responsive to the identification of the error, a notification to the current user, and wherein the notification is curated based on the custom frustration threshold associated with the current user.

* * * * *